United States Patent [19]

Mather

[11] Patent Number: 4,742,926

[45] Date of Patent: May 10, 1988

[54] ARCHED CURTAIN ROD

[75] Inventor: Clarence H. Mather, Montclair, N.J.

[73] Assignee: Arley Merchandise Corporation, Taunton, Mass.

[21] Appl. No.: 53,082

[22] Filed: May 22, 1987

[51] Int. Cl.[4] ..... A47F 5/08

[52] U.S. Cl. ..... 211/105.3; 211/123

[58] Field of Search ..... 211/105.1, 123, 105.2, 211/105.3

[56] References Cited

U.S. PATENT DOCUMENTS

| | | | |
|---|---|---|---|
| 2,201,043 | 5/1940 | Kirsch | 211/105.3 |
| 2,223,282 | 11/1940 | Dover | 211/105.2 |
| 2,237,710 | 4/1941 | McMurry | 211/105.2 |
| 2,890,799 | 6/1959 | Rosenbaum | 211/105.2 |
| 4,496,059 | 1/1985 | Leiter | 211/105.1 |

*Primary Examiner*—Robert W. Gibson, Jr.

*Attorney, Agent, or Firm*—Lahive & Cockfield

[57] ABSTRACT

A device for supporting a curtain is disclosed. An elongated support rod has an arched portion in the center and straight portions extending from each end of the arched portion. The end portions may be either rigidly or pivotably coupled to the arched element. The arched element may be comprised of one portion or a number of sub-portions. The sub-portions are slideably interfitted to permit adjustment of the extension of the rod. The support rod may include elements for mounting to a wall or other surface.

9 Claims, 1 Drawing Sheet

ARCHED CURTAIN ROD

BACKGROUND OF THE INVENTION

This invention relates to drapery and curtain rods. More particularly it relates to curtain rods which may be adapted to be mounted to a wall or other surface.

Draperies, curtains and other window hangings serve several purposes. They may insulate a room against the cold or heat, restrain rays of the sun, provide privacy or merely serve decorative purposes. There is a large variety of window types including but not limited to bay, casement, corner, double, dormer, french and single. Many of these windows are best suited for a particular curtain treatment and therefore particular curtain rods. On the other hand, many windows are suited for aesthetic treatment with a variety of curtain arrangments. The desired arrangements can be achieved with the appropriate rod or other support member.

Several types and styles of curtain rod devices are known in the art. There are straight, elongated curtain rods which are either non-extendable or slidably adapted for extension to a desired length. Often these devices include more than one rod element. For example, a double or triple device may be composed of two or three slidingly interfitting elongated rods. The double rod suits a curtain and valance or two sets of curtains and the triple rod suits three sets of curtains and a variety of arrangements. In addition, swing arm rods, bay window extension rods, corner rods and traverse rods are known in the art. In addition, there are curved rods which, when mounted to the wall, project outwardly from the wall.

Accordingly, it is an object of this invention to provide a curtain rod adapted to be arched in a direction offset from a horizontal plane. It is another object of this invention to provide an arched curtain rod which is adjustable so as to be extended to a desired length. It is also an object of this invention to provide an arched curtain rod with interfitting sections allowing adjustment of extension of the rod.

SUMMARY OF THE INVENTION

The present invention is an arched curtain rod having an elongated member with end portions adapted for positioning along a horizontal reference axis with a predetermined orientation. The elongated member includes an arched portion between the end portions. In operation, the arched portion extends along an arc above the horizontal plane passing through the reference axis when the end portions are affixed along the reference axis, such as when mounted to the wall.

In preferred embodiments, the curtain rod is adjustable in overall length. In one such embodiment, the support member includes two elements and the arched portion includes two sub-portions. Each element of the support member includes an end portion coupled to a sub-portion of the arched portion. The sub-portions are adapted for slidably interfitting engagement along the arc. The end portions may either by rigidly coupled or pivotably coupled to the sub-portions of the arched portion.

In a preferred embodiment, the support member includes three elements and the arched portion is composed of three sub-portions. Two of the elements are each composed of an end portion coupled to a sub-portion of the arched portion. The third element is the third sub-portion of the arche portion adapted at one end for slidable interfitting engagement with the first sub-portion and adapted at the other end for slidable interfitting engagement with the second sub-portion along the arc. The end portions of the device may be rigidly coupled or pivotably coupled to the sub-portion of the arched portion.

DESCRIPTION OF THE PREFERRED EMBODIMENTS

Figure 1:
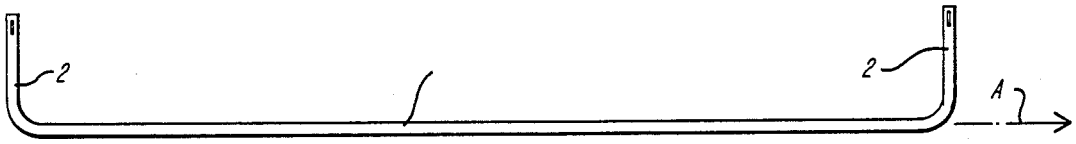
FIG. 1 is a top view of the arched elongated support member.
Figure 2:
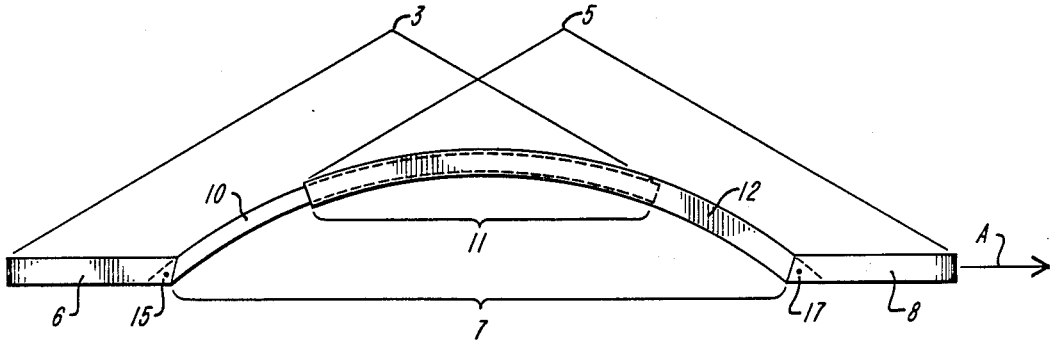
FIG. 2 is a front view of an embodiment of the arched elongated support member composed of two elements and end portions pivotable coupled to the arched section for adjustment to a desired extension.
Figure 3:
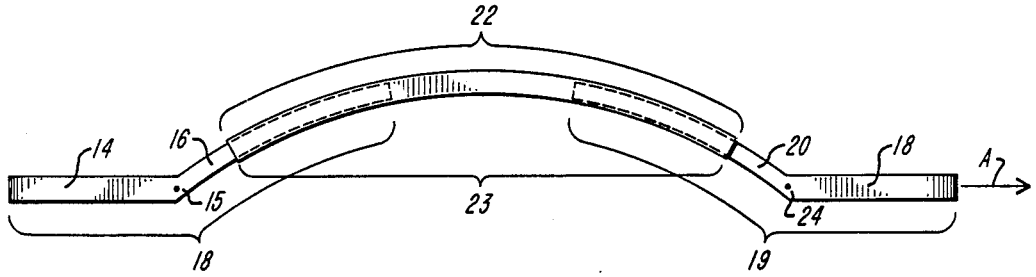
FIG. 3 is a front view of an embodiment of the arched elongated support member composed of three elements for adjustment to a desired extension.
Figure 4:
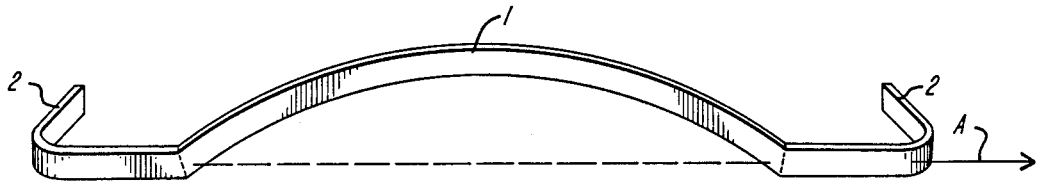
FIG. 4 is a perspective view of the arched elongated support member with elements coupled to each end portion for mounting the rod to a surface.

As shown in FIGS. 1 and 4, the invention includes an elongated support member 1 which may have extensions 2 adapted for mounting to a reference surface, such as a wall. As shown, the member 1 extends along a reference axis denoted A in FIG. 1-4. The length of the rod along axis A is not limited and may be a standard dimension or adjustable. The cross-section shape of the rod may be of any conventional type, such as circular or elliptical, as desired. In one embodiment, as shown in FIG. 2, the apparatus comprises a first element 3 and a second element 5, providing an end portion 6 and an end portion 8, and an arched portion 7. The arched portion 7 includes two sub-portions 10 and 12. The first end portion 6 is coupled at point 15 to one end of the sub-portion 10. The second end portion 8 is coupled at point 17 to one end of the sub-portion 12. The first sub-portion 10 and second sub-portion 12 of the arched portion 17 are adapted for slidable interfitting engagement along a circular arc. The overlap of this interfitting engagement is indicated by reference designation 11 in FIG. 2.

In one form of the invention, the first end portion 6 may be rigidly coupled at point 15 to the first sub-portion 10 of the arched portion 7 and the second end portion 8 may be rigidly coupled at point 17 to the second sub-portion 12. In another embodiment, the first end portion 6 and the first sub-portion 10 may be pivotably coupled about an axis passing through point 15 and the second end portion 8 and second sub-portion 12 may be pivotably coupled about an axis passing through point 17. Such pivotable coupling enables the desired alignment of the two end portions 6 and 8 along the horizontal axis A while permitting variable spacing of portions 6 and 8 along axis A. The arc established by arched portion 7 is preferably circular and extends above the horizontal plane passing through the horizontal axis.

As shown in FIG. 3, the apparatus may include three elements denoted 18, 19, and 22. The arched portion 23 includes three sub-portions 16, 20, and 22. The first of these three elements 18 of the apparatus includes an end portion 14 coupled at point 15 to the first sub-portion 16 of the arc. A second element 19 includes the second end portion 18 coupled at point 24 to the second sub-portion 20 of the arc. The third element includes the third sub-portion 22 of the arched portion 23. Portion 23 includes ends adapted for slidable interfitting engagement with the first sub-portion 16 and the second sub-portion 20 of the arched portion. At the coupling points 15 and 24, the end portions 14 and 18 respectively may be rigidly coupled or pivotably coupled to the arched portions.

In operation the rod is adjusted to the desired extension by sliding the arched sub-portion either away from or toward one another. In the non-extendable embodiments the rod is of a predetermined desired length and therefore adjustment is not necessary. Curtains, draperies or other hangings are placed on the rods either by sliding the rod through a top seam in the curtains or with hooks or other means for attaching the curtains to the rod. The rods may be mounted to a wall or reference surface. When the rod is mounted to a surface the arch projecting upwardly creates a decorative effect of a "cathedral" type curtain.

It will thus be seen that the objects set forth above, among those made apparent from the preceding description, are efficiently attained. It is intended that all matter contained in the above description or shown in the accompanying drawings be interpreted as illustrative and not in a limiting sense. The invention may be embodied in other specific forms without departing from the spirit and scope thereof. Accordingly, other embodiments are within the following claims.

What is claimed is:

1. Apparatus for supporting a curtain, comprising:

an elongated support member having end portions adapted to be fixedly positioned and extending along a horizontal reference axis with a predetermined orientation, said support member including an arched portion disposed between said end portions, said arched portion extending along an arc above the horizontal plane passing through said reference axis when said end portions are affixed along said reference axis, and said support member is in said predetermined orientation.

2. Apparatus according to claim 1 wherein said support member comprises two elements, and said arched portion includes two sub-portions, wherein one of said elements includes a first of said end portions coupled to a first of said sub-portions, the other of said elements includes a second of said end portions coupled to a second of said sub-portions, and wherein said first and second sub-portions are adapted for slidable interfitting engagement along said arc.

3. Apparatus according to claim 2 wherein said first end portion and said first sub-portion are rigidly coupled and said second end portion and said second sub-portion are rigidly coupled.

4. Apparatus according to claim 2 wherein said first end portion and said first sub-portion are pivotably coupled and said second end portion and said second sub-portion are pivotably coupled.

5. Apparatus according to claim 1 wherein said support member comprises three elements and said arched portion includes three sub-portions, wherein one of said elements includes a first of said end portions coupled to a first of said sub-portions, the other of said elements includes a second of said end portions coupled to a second of said sub-portions, and wherein the third of said elements includes the third of said sub-portions, wherein a first end of said third sub-portion is adapted for slidable, interfitting engagement with said first sub-portion along said arc, and the second end of said third sub-portion is adapted for slidable, interfitting engagement with said second sub-portion along said arc.

6. Apparatus according to claim 5 wherein said first end portion and said first sub-portion are rigidly coupled and said second end portion and said second sub-portion are rigidly coupled.

7. Apparatus according to claim 5 wherein said first end portion and said first sub-portion are pivotably coupled and said second end portion and said second sub-portion are pivotably coupled.

8. Apparatus according to claim 1 wherein said arched portion extends along a circular arc.

9. Apparatus according to claim 1 further comprising means for coupling said end portions to a reference surface.

* * * * *